US010979823B2

(12) United States Patent
Song et al.

(10) Patent No.: US 10,979,823 B2
(45) Date of Patent: Apr. 13, 2021

(54) SOUND GENERATOR

(71) Applicant: AAC Technologies Pte. Ltd., Singapore (SG)

(72) Inventors: Wei Song, Shenzhen (CN); Fan Zhang, Shenzhen (CN); Weiwei Tao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/699,156

(22) Filed: Nov. 29, 2019

(65) Prior Publication Data

US 2020/0204923 A1 Jun. 25, 2020

(30) Foreign Application Priority Data

Dec. 20, 2018 (CN) ..... 201822149197.1

(51) Int. Cl.

| | |
|---|---|
| ***H04R 25/00*** | (2006.01) |
| ***H04R 15/00*** | (2006.01) |
| ***H04R 7/12*** | (2006.01) |
| ***H04R 7/16*** | (2006.01) |
| ***H04R 1/28*** | (2006.01) |

(52) U.S. Cl.

CPC ..... *H04R 15/00* (2013.01); *H04R 1/2811* (2013.01); *H04R 7/127* (2013.01); *H04R 7/16* (2013.01)

(58) Field of Classification Search

CPC ..... H04R 9/06; H04R 9/025; H04R 2400/11; H04R 2400/07; H04R 9/043; H04R 15/00; H04R 7/127; H04R 7/16; H04R 1/2811

See application file for complete search history.

(56) References Cited

U.S. PATENT DOCUMENTS

| | | | | |
|---|---|---|---|---|
| 9,813,821 | B1 * | 11/2017 | Song | H04R 9/025 |
| 10,003,887 | B2 * | 6/2018 | Linghu | H04R 9/04 |
| 10,250,989 | B1 * | 4/2019 | Xiao | H04R 31/003 |
| 10,284,959 | B2 * | 5/2019 | Xiao | H04R 9/06 |
| 10,820,107 | B2 * | 10/2020 | Feng | H04R 9/025 |
| 2009/0136065 | A1 * | 5/2009 | Yano | H04R 31/006 381/186 |
| 2020/0045434 | A1 * | 2/2020 | Zhou | H04R 7/122 |
| 2020/0045435 | A1 * | 2/2020 | Hu | H04R 7/127 |
| 2020/0204923 | A1 * | 6/2020 | Song | H04R 15/00 |

* cited by examiner

*Primary Examiner* — Phylesha Dabney
(74) *Attorney, Agent, or Firm* — W&G Law Group LLP

(57) ABSTRACT

A sound generator is provided by the present disclosure. The sound generator includes a frame; a magnetic circuit system fixed by the frame; and a vibration system carried by the frame. The vibration system includes a diaphragm and a voice coil fixed below the diaphragm for driving the diaphragm to vibrate. The voice coil includes a pair of parallel long axis edges, a pair of parallel short axis edges connected with ends of the long axis edges. The diaphragm includes a through hole formed corresponding to the long shaft edge of the voice coil, and a glue part filled in the through hole for connecting the long shaft edge of the voice coil with the diaphragm.

8 Claims, 3 Drawing Sheets

SOUND GENERATOR

FIELD OF THE PRESENT DISCLOSURE

The present disclosure relates to the field of electroacoustic transducers, more particularly to a sound generator used in a mobile electronic device.

DESCRIPTION OF RELATED ART

With the arrival of the mobile internet era, the number of intelligent mobile equipment rises continuously. In a plurality of mobile equipment, the mobile phone is undoubtedly the most common, most portable mobile terminal equipment. At present, the functions of the mobile phone and the functions of the mobile phone are various. One of the functions of the mobile phone is a high-quality music function, and a loudspeaker, in the mobile phone is one of the necessary component for achieving the high-quality music performance.

In related art, the voice coil is directly connected with the diaphragm by glue, and the glue occupies the vibration space of the diaphragm, so that the actual vibration space of the diaphragm is smaller than the theoretical design space. Accordingly, the acoustic performance of the sound generator is badly affected.

Therefore, it is necessary to provide an improved sound generator to solve the problems mentioned above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
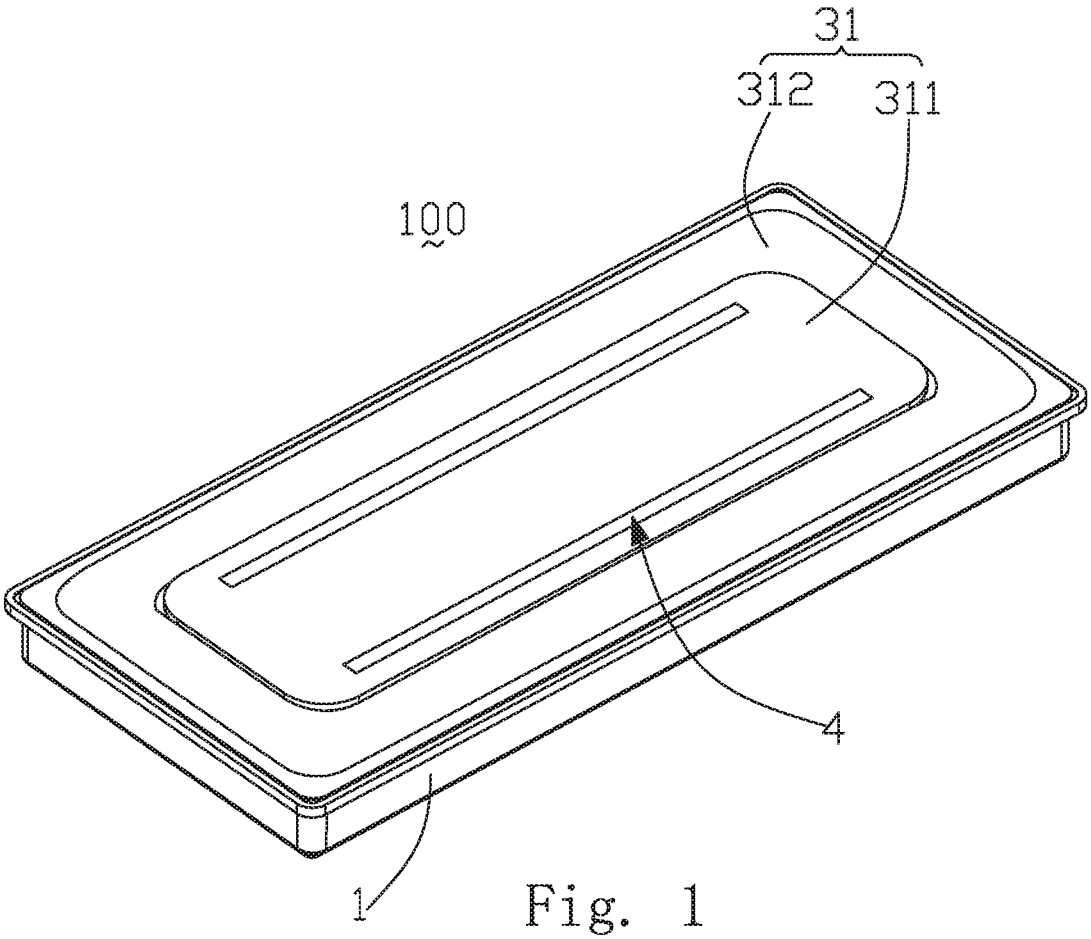
FIG. 1 is an isometric view of a sound generator in accordance with an exemplary embodiment of the present disclosure.
Figure 2:
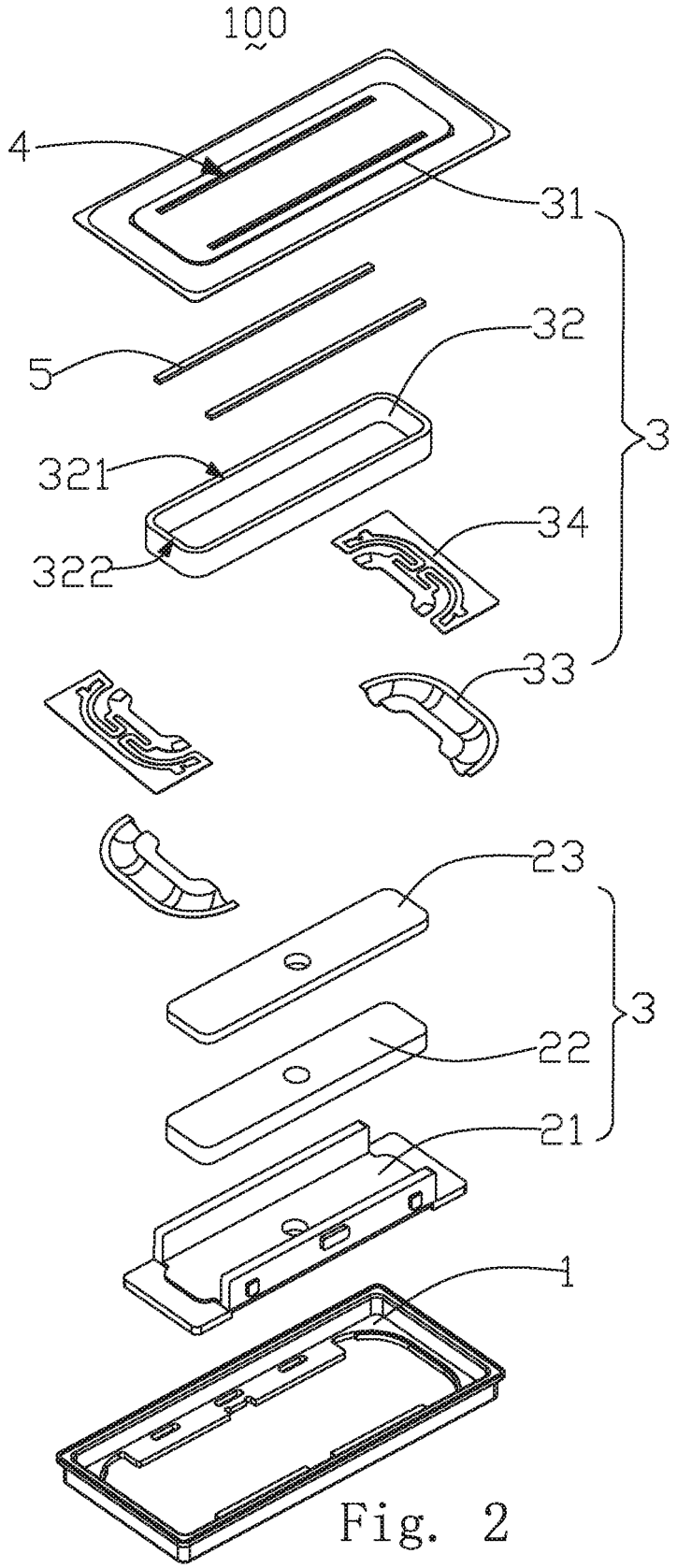
FIG. 2 is an exploded view of the sound generator.

Referring to FIGS. 1-2, the present disclosure provides a sound generator 100, comprising a frame 1, a magnetic circuit system 2, and a vibration system 3 fixedly connected to the frame 1.

The magnetic circuit system 2 comprises a magnetic yoke 21, a main magnet 22 assembled at a center of the magnetic yoke 21, and a main pole plate 23 attached to a top of the main magnet 22. The main pole plate 23 is used for conducting magnetism on the main magnet 22, reducing the flow of magnetic force lines, and effectively improving the driving force of the magnetic circuit system 2.

The vibration system 3 comprises a diaphragm 31, a voice coil 32 fixed below the diaphragm 31 and driving the diaphragm 31 to vibrate for generating sound, an auxiliary diaphragm 33 fixed to the frame 1, and a suspension 34 for supporting the voice coil 32 and electrically connected with the voice coil 32.

The diaphragm 31 includes a membrane 311 fixed to the frame 1 and a dome 312 attached to an upper surface of the membrane 311. The dome 312 is fixed to the membrane 311. The dome 312 is fixed to the upper surface of the membrane 311 by adhesive.

The voice coil 32 comprises a pair of parallel long axis edges 321 and a pair of parallel short axis edges 322. The long axis edges 321 and the short axis edges 322 are connected end to end to form the voice coil 32.

One end of the auxiliary diaphragm 33 is fixed to the frame 1, and the other end of the auxiliary diaphragm 33 is fixed at one end of the voice coil 32 far away from the membrane 311.

The suspension 34 is sandwiched between the voice coil 32 and the auxiliary diaphragm 33, one end of the suspension 34 is fixed to the frame 1, and the other end of the suspension 34 is fixed to one end of the voice coil 32 far away from the membrane 311.

Figure 3:
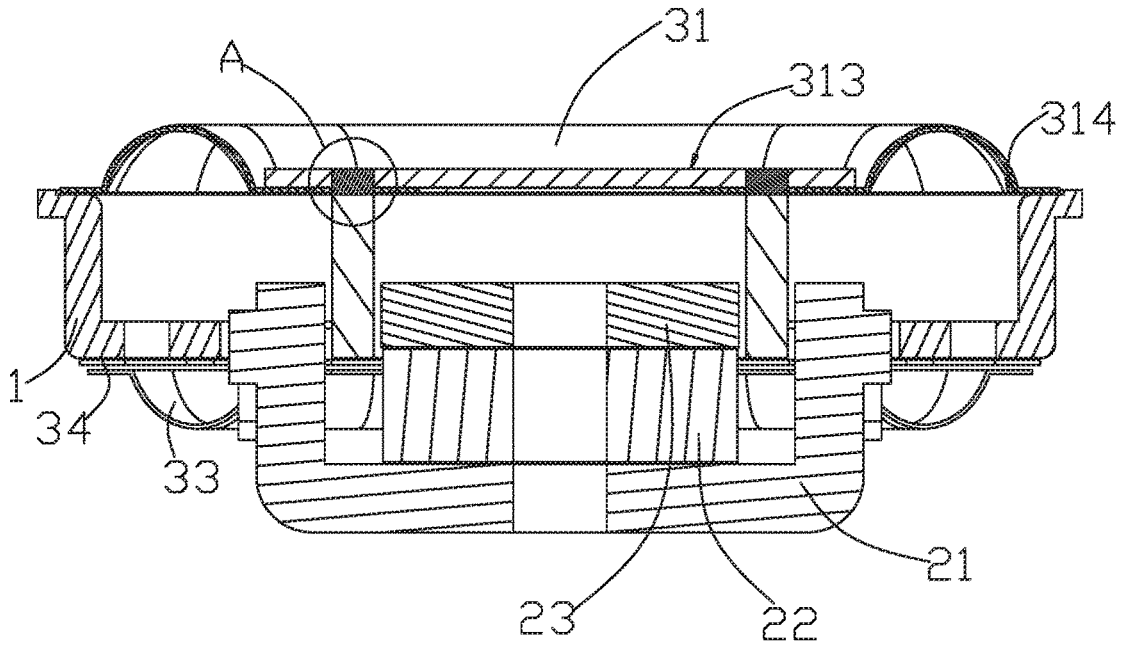
FIG. 3 is a cross-sectional view of the sound generator.
Figure 4:
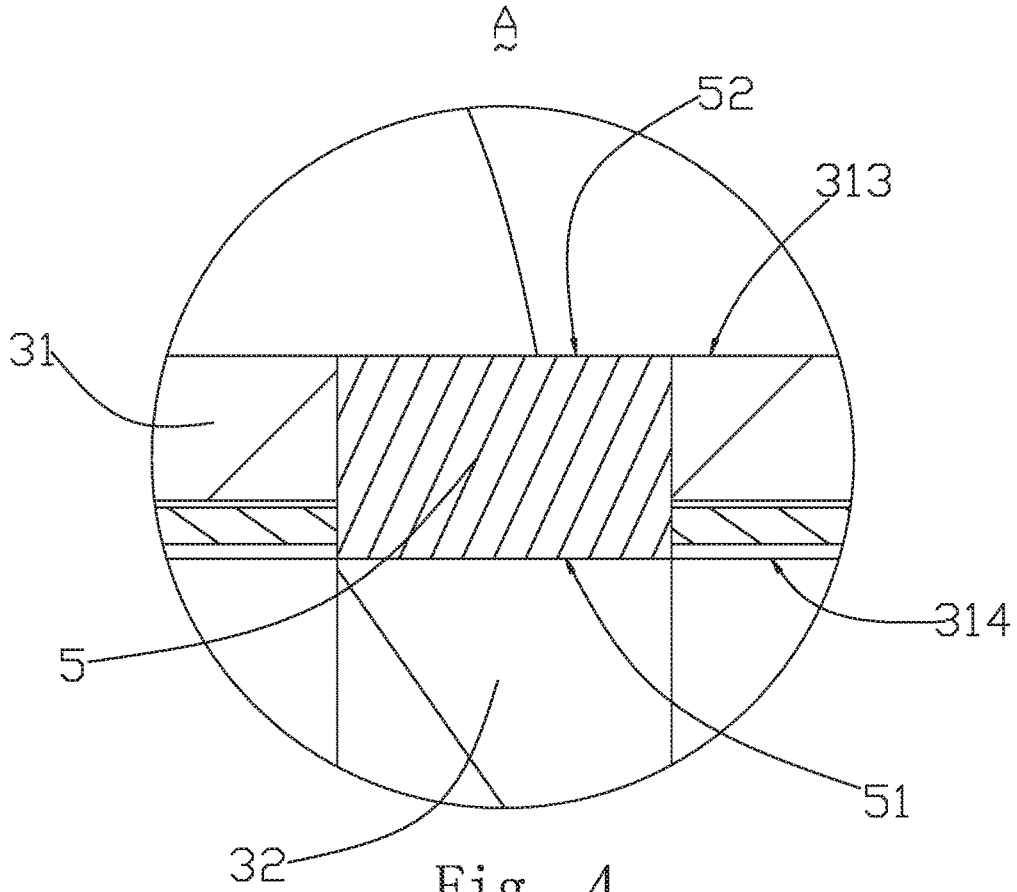
FIG. 4 is a partial enlarged view of Part A shown in FIG. 3.

Referring to FIGS. 3-4, a through hole 4 is formed in a selected position of the diaphragm 31 corresponding to the long axis edge 321; and a glue part 5 is filled in the through hole 4. The long axis edges 321 are glued and fixed with the diaphragm 31 by the glue part 5.

The diaphragm 31 includes an upper surface 313 away from the magnetic circuit system 2 and a lower surface 314 opposite to the upper surface 313. The through hole 4 penetrates through the upper surface 313 and the lower surface 314, namely, the through hole 4 penetrates through the membrane 311 and the dome 312 in sequence.

The glue part 5 comprises a first surface 51 adhered with the voice coil 32 and a second surface 52 opposite to the first surface 51. Further, the second surface 52 is coplanar with the upper surface 313.

Preferably, the shape of the through hole 4 is matched with the shape of the long axis edge 321, and specifically, the through holes 4 are long-strip-shaped. The number of the through holes 4 is two, and the cross section of the through hole 4 is rectangular.

Compared with the related art, two through holes matched with the shape of the long axis edges of the voice coil are formed corresponding to the two long axis edges of the voice coil. In addition, a glue part is filled in the through holes to enable the voice coil to be connected with the diaphragm through the glue part, so that the glue is prevented from overflowing to the surface of the diaphragm to occupy the vibration space of the diaphragm. Furthermore, the actual vibration space of the diaphragm is equal to the theoretical design space, the z-direction space utilization rate is better, and the sound performance of the sound generator is improved.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sound generator, comprising:

a frame;

a magnetic circuit system fixed by the frame;

a vibration system carried by the frame, comprising a diaphragm and a voice coil fixed below the diaphragm for driving the diaphragm to vibrate; wherein the voice coil includes a pair of parallel long axis edges, a pair of parallel short axis edges connected with ends of the long axis edges; and wherein the diaphragm includes a through hole formed corresponding to the long shaft edge of the voice coil, and a glue part filled in the through hole for connecting the long shaft edge of the voice coil with the diaphragm.

2. The sound generator as described in claim 1, wherein the diaphragm comprises an upper surface far away from the magnetic circuit system and a lower surface opposite to the upper surface; the through hole penetrates through the upper surface and the lower surface.

3. The sound generator as described in claim 2, wherein the glue part comprises a first surface fixed with the voice coil by adhering and a second surface opposite to the first surface, further, the second surface is coplanar with the upper surface.

4. The sound generator as described in claim 1, wherein a shape of the through hole is matched with a shape of the long axis edge.

5. The sound generator as described in claim 1, wherein the diaphragm comprises a membrane fixed on the frame and a dome attached to the membrane; the through hole penetrates through the membrane and the dome in sequence.

6. The sound generator as described in claim 5, wherein the vibration system further comprises an auxiliary diaphragm fixed to the frame, one end of the auxiliary diaphragm is fixed to the frame, and the other end of the auxiliary diaphragm is fixed at one end of the voice coil far away from the membrane.

7. The sound generator as described in claim 6, further comprising a suspension supporting and electrically connected with the voice coil, wherein the suspension is sandwiched between the voice coil and the auxiliary diaphragm.

8. The sound generator as described in claim 1, wherein the magnetic circuit system comprises a magnetic yoke, a main magnet assembled at a center of the magnetic yoke, and a main pole plate attached to a top of the main magnet.

* * * * *